US008858260B2

(12) United States Patent
Saito

(10) Patent No.: US 8,858,260 B2
(45) Date of Patent: Oct. 14, 2014

(54) SHIELDED CONNECTOR

(75) Inventor: Atsuhito Saito, Susono (JP)

(73) Assignee: Yazaki Corporation, Tokyo (JP)

( * ) Notice: Subject to any disclaimer, the term of this patent is extended or adjusted under 35 U.S.C. 154(b) by 101 days.

(21) Appl. No.: 13/602,702

(22) Filed: Sep. 4, 2012

(65) Prior Publication Data

US 2013/0059472 A1 Mar. 7, 2013

(30) Foreign Application Priority Data

Sep. 7, 2011 (JP) ..... 2011-195369

(51) Int. Cl.
*H01R 13/648* (2006.01)
*H01R 12/72* (2011.01)

(52) U.S. Cl.
CPC ..... *H01R 13/648* (2013.01); *H01R 12/724* (2013.01)
USPC ..... 439/607.27

(58) Field of Classification Search
USPC ..... 439/607.27, 607.35, 607.4
See application file for complete search history.

(56) References Cited

U.S. PATENT DOCUMENTS

| | | | | |
|---|---|---|---|---|
| 5,718,605 | A * | 2/1998 | Morikawa et al. | 439/607.27 |
| 8,206,177 | B2 * | 6/2012 | Chang | 439/607.35 |
| 2005/0118879 | A1 | 6/2005 | Shimizu | |
| 2006/0035526 | A1 | 2/2006 | Shimizu | |
| 2008/0038951 | A1 | 2/2008 | He et al. | |
| 2011/0136384 | A1 | 6/2011 | Chang | |

FOREIGN PATENT DOCUMENTS

| | | | |
|---|---|---|---|
| CN | 2523058 | Y | 11/2002 |
| CN | 2657225 | Y | 11/2004 |
| CN | 1622396 | A | 6/2005 |
| CN | 200941504 | Y | 8/2007 |
| CN | 201570596 | U | 9/2010 |
| JP | 08130052 | A | 5/1996 |
| JP | 2005-038725 | A | 2/2005 |
| JP | 2005158630 | A | 6/2005 |
| JP | 2006-310164 | A | 11/2006 |

OTHER PUBLICATIONS

Office Action dated Jun. 30, 2014, issued by the State Intellectual Property Office of the People's Republic of China in counterpart Chinese Application No. 201210327852.2.

* cited by examiner

*Primary Examiner* — Phuong Dinh
(74) *Attorney, Agent, or Firm* — Sughrue Mion, PLLC

(57) ABSTRACT

There is provided a shielded connector that can prevent collapse of a cantilever wall in a housing while pursing a lower profile. A shielded connector has a tubular inner shell that covers terminals for connection with another connector; an outer shell that covers the inner shell; and a housing for retaining the inner shell in the outer shell. The outer housing has receiving grooves formed in an indented manner in free-end side walls of a cantilever wall that extends along an interior wall of the outer shell in a direction of insertion of the connector and that has a lock receiving portion to engage with a lock portion of another connector. The outer shell has, in upper portions of respective leading-side side walls, supporting projections to engage with the receiving grooves of the cantilever wall.

2 Claims, 5 Drawing Sheets

RELATED ART

SHIELDED CONNECTOR

BACKGROUND OF THE INVENTION

The present invention relates to a shielded connector to be attached to a circuit board.

A hitherto known shielded connector to be mounted on a circuit board has a plurality of board-side terminals that are arranged in parallel to each other so as to contact terminals of another connector and that are all preliminarily given a 90° angle bend in order to align their rear ends to respective through holes of the circuit board (see; for instance, Patent Document 1).

A shielded connector 501 of this type shown in FIG. 5A is substantially made up of a main housing 503; a connector housing 505 accommodated in the main housing 503; an inner shielding case 507 that is accommodated in the connector housing 505 and that is formed from a conductive plate; a plug contact 509 disposed in the midst of a plug insertion space enclosed by the inner shielding case 507 within the connector housing 505 so as to contact another connector; and an outer shielding case 511 formed from a conductive plate so as to cover the main housing 503.

As in the case with the shielded connector 501, in a case where an entire shield contact is covered with the outer shielding case 511 for shielding purpose, the outer shielding case 511 can be made smaller by giving a 90° angle bend to a rear end of an upper terminal 514 and a rear end of a lower terminal 515, both of which are set in the plug contact 509, in agreement with through holes of a circuit board. Accordingly, there is yielded an advantage of the ability to miniaturize the shielded connector 501.

A shielded connector to be mounted on a circuit board is intended to pursue further miniaturization (see; for instance, Patent Document 2).

In a shielded connector 516 of this type shown in FIG. 5B, a plurality of terminals 519 have each contact portions 517 extending in a direction along which the shielded connector is inserted into and disconnected from another connector, and the contact portions 517 are disposed at a predetermined interval on a placement board 521. During insertion or disconnection of the connector, the contact portions 517 contact their unillustrated counterpart contact portions of the other connector. An unillustrated lock hole with which a lock of the other connector is to engage is formed in an upper surface of a shielding case 523 formed by bending a metal plate. The placement board 521 intended for mounting of the contact portions 517 is formed so as to situate on an interior surface of only one side wall making up a portion of an external wall of the housing 525. Specifically, the placement board 521 of a housing main body 527 is formed as one side wall that works as the external wall, and there is no wall opposing the placement board 521. This makes it possible to reduce a thickness of the shielded connector with respect to a board surface of a circuit board 513 in the right angle direction; namely, to make a so-called profile of the shielded connector lower.

Patent Document 1: Japanese Patent Publication No. JP-A-H8-130052

Patent Document 2: Japanese Patent Publication No. JP-A-2005-158630

However, when only the portion (the placement board 521) of the external wall of the housing 525 is left in order to accomplish much further reductions in the profile and the weight of the aforementioned shielded connector 501, the thus-left portion of the external wall assumes the shape of a cantilever, which arouses concern for collapse of the cantilever wall to the inside of the connector designated by arrow "a" in FIG. 5B.

SUMMARY

The present invention has been conceived in light of the situations and aims at providing a shielded connector that can prevent collapse of a cantilever wall in a housing while pursuing a lower profile of the shielded connector.

According to one aspect of the embodiments of the present invention, there is provided a shielded connector comprising:

a tubular inner shell that covers terminals for connection with another connector;

an outer shell that covers the inner shell; and a housing for retaining the inner shell in the outer shell, wherein the housing has a cantilever wall that extends in a direction of insertion of the connector along an interior wall of an outer shell and that has a lock receiving portion to engage with a lock portion of the other connector, and wherein the outer shell has a collapse prevention structure that prevents the cantilever wall from being collapsed to the inward direction of the connector upon engagement with a free end of the cantilever wall.

In the shielded connector configured as above described, the housing is disposed within the outer shell, and the inner shell is disposed within the housing. The inner she is positioned with respect to the outer shell by means of the housing interposed between the outer shell and the inner shell. In the housing, only the one cantilever wall making up a portion of external walls is placed so as to oppose a surface of the circuit board within the outer shell. Specifically, the cantilever wall is formed as one of side walls of the housing, and there is no wall opposing the cantilever wall. This makes it possible to reduce a thickness of the shielded connector with respect to the board surface of the circuit board; namely, to make a so-called profile of the shielded connector lower. Furthermore, when the housing is inserted into the outer shell, the collapse prevention structure of the outer shell hinders collapse of the cantilever wall to the inside (inward direction) of the connector. In addition, the lock receiving portion to engage with a lock portion of the other connector is provided in the housing, whereby the wearing away of the lock portion of the other connector formed likewise from a resin can be prevented.

In the above mentioned shielded connector, the collapse prevention structure may be made up of supporting projections that are projectingly provided on leading-side side walls of the outer shell so as to engage with receiving grooves formed, in an indented manner, in free-end side walls of the cantilever wall along a direction of insertion of the connector.

In the shielded connector configured as above described, when the housing is inserted into the outer shell, the supporting projections of the outer shell are inserted into the receiving grooves formed on the cantilever wall of the housing, and the cantilever wall is thereby supported by the supporting projections, thereby regulating collapse of the cantilever wall to the inside of the connector. Specifically, the collapse prevention structure is formed from a simple structure made up of the receiving grooves and the supporting projections. When the housing is inserted into the outer shell, the free-end side surfaces of the cantilever wall are supported and thereby guided by the supporting projections of the outer shell by way of the receiving grooves, thereby preventing rattling or tilting of the housing. Ease of insertion of the housing is thereby improved.

The shielded connector of the present invention can prevent collapse of the cantilever wall in the housing while pursuing a lower profile of the housing.

The present invention has been briefly described thus far. Details of the present invention will become more clear by reading through a mode for implementing the present invention (hereinafter called an "embodiment") to be described below, by reference to the accompanying drawings.

DETAILED DESCRIPTION OF EMBODIMENTS

A shielded connector of an embodiment of the present invention is hereunder described in detail by reference to the accompanying drawings.

A shielded connector 11 of the present embodiment can preferably be used as a USB 2.0 (a high speed transmission differential connector) shielded connector for mounting on a circuit board. Accordingly, another connector that is to be coupled with the shielded connector 11 is a shielded connector 13 of a cable.

Figure 1:
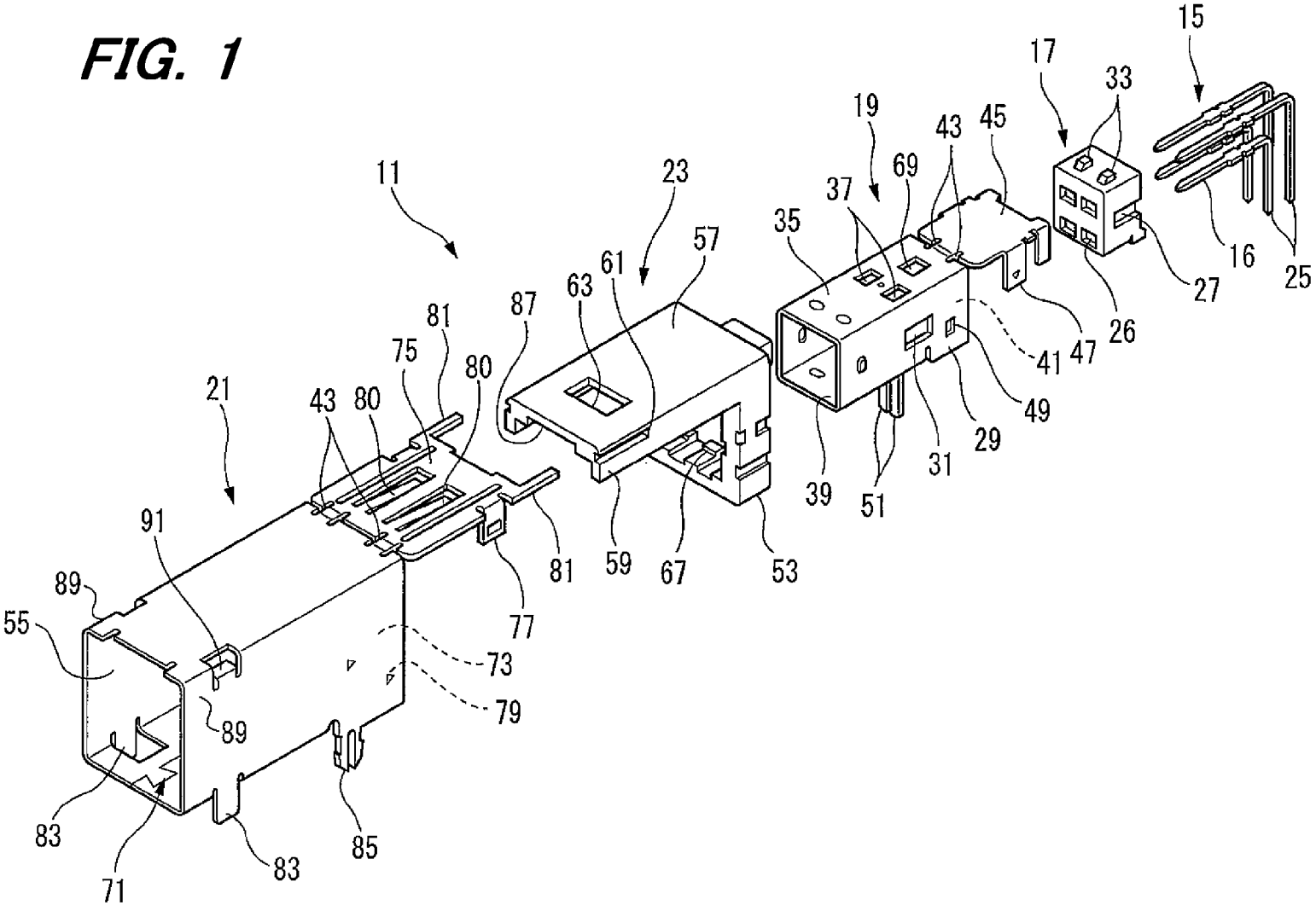
FIG. 1 is an exploded perspective view of a shielded connector of an embodiment of the present invention.

As shown in FIG. 1, the shielded connector 11 has terminals 15; an inner housing 17; an inner shell 19; an outer shell 21; and an outer housing (housing) 23. Throughout the specification, the shielded connector 11 will be described on the premise that a side of the connector to be coupled with another connector is taken as a front side and that the other side of the connector is taken as a rear side.

The terminals 15 are formed by means of sheet metal working. In the present embodiment, the terminals 15 are formed as male terminals that have each tab-shaped electric contact portions 16. The electric contact portions 16 contact respective inner contact pieces of female terminals having unillustrated box-shaped electric contact portions of the other connector. The terminals 15 to contact the respective female terminals of the other connector are arranged in two parallel rows like pairs. Each of rear end leads 25 of the terminals 15 is preliminarily given a 90° angle bend in agreement with each of through holes of an unillustrated circuit board and fastened to the inner housing 17. The rear end leads 25 are soldered to the respective through holes of a predetermined circuit formed on the circuit board.

Figure 2:
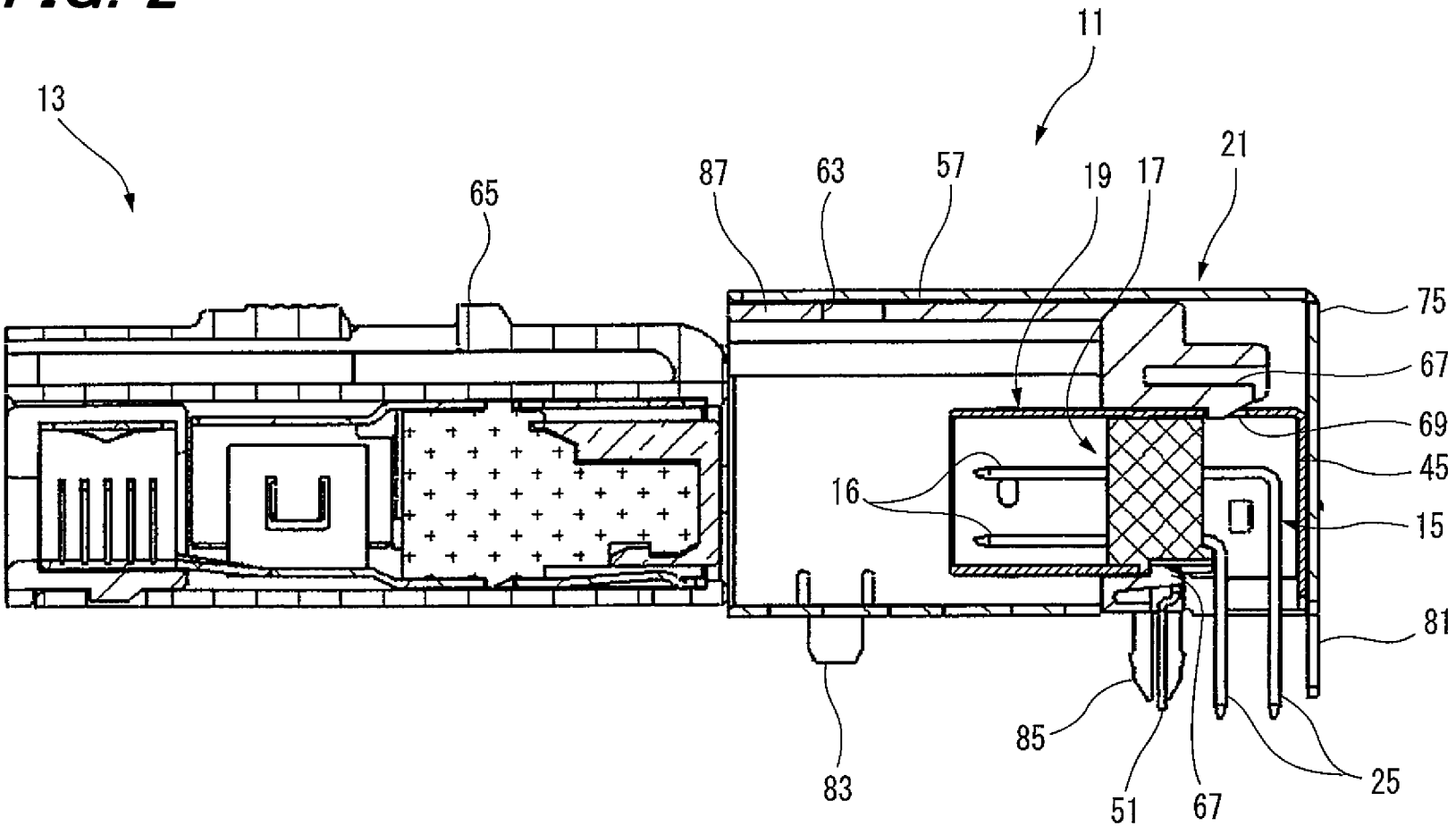
FIG. 2 is a longitudinal cross sectional view showing the shielded connector shown in FIG. 1 along with another connector.

The inner housing 17 is molded from an insulating material, such as a synthetic resin. A plurality of terminal fixing holes 26 for attachment of the respective terminals 15 are formed in the inner housing 17. A side wall engagement groove 27 is formed on either side of the inner housing 17 and is engaged with each of side wall engagement portions 31 of an inner shell side wall 29. A pair of inner engagement claws 33 are projectingly formed on an upper surface of the inner housing 17, and the inner engagement claws 33 are engaged with upper wall engagement holes 37 of the inner shell upper wall 35. As shown in FIGS. 1 and 2, the side wall engagement grooves 27 and the inner engagement claws 33 are respectively engaged, whereby the inner housing 17 is fastened to a substantial center at the inside of the inner shell 19.

The inner shell 19 is formed by shaping a conductive metallic plate into a shape of an angled tube. One end of the inner shell 19 forms an opening 39 for receiving terminals of another connector, and the other end of the inner shell 19 forms an inner housing insertion opening 41 into which the inner housing 17 is to be fitted. The inner shell 19 covers the terminals 15 for connection with the other connector. The side wall engagement portions 31 to engage with the respective side wall engagement grooves 27 of the inner housing 17 are formed on the respective inner shell side walls 29. The upper wall engagement holes 37 with which the respective inner engagement claws 33 of the inner housing 17 are to engage are formed in the inner shell upper wall 35.

An inner rear dosing plate 45 is joined to the inner housing insertion opening 41 of the inner shell 19 by way of hinges 43. Inner engagement pieces 47 are provided on both sides of the inner rear closing plate 45. At a position where the inner rear closing plate 45 has closed the inner housing insertion opening 41, the inner engagement pieces 47 are engaged with inner engagement recesses 49 of the respective inner shell side walls 29. The inner rear closing plate 45 is thereby held in a state where it closes the inner housing insertion opening 41. First board connection portions 51 that are soldered to the respective through holes of the circuit board and simultaneously connected to a ground of the circuit bard are vertically provided on a lower surface of the inner shell 19.

The outer housing 23 is formed from an insulating material, such as a synthetic resin, and includes a housing body 53 assuming a shape of a rectangular frame. The outer housing 23 holds the inner shell 19 within the outer shell 21. A cantilever wall 57 extending along a direction of insertion or disconnection of the connector is formed along outer shell interior walls 55 in the housing body 53. Receiving grooves 61 are formed in an indented manner in respective free-end side surfaces 59 of the cantilever wall 57. A lock receiving portion 63 assuming a shape of an angular hole is formed in the cantilever wall 57, and the lock receiving portion 63 is engaged with a lock portion 65 of the other connector. In addition to having the lock receiving portion 63, the cantilever wall 57 of the outer housing 23 also has a function of preventing wrong insertion of a dissimilar connector (a coding function) so as to prevent insertion of another connector having the same shape.

As shown in FIG. 2, inner shell engagement claws 67 are formed one above the other in the rear of the housing body 53. When the inner shell 19 is fitted up to a predetermined position in the housing body 53, the inner shell engagement claws 67 are engaged with inner shell engagement portions 69 of the inner shell 19, to thus fixedly retain the inner shell 19.

The outer shell 21 is formed into a shape of an angled tube from a conductive metal plate. One end of the outer shell 21 forms an opening 71 for coupling with another connector, and the other end of the same forms an outer housing insertion opening 73 for attachment of the outer housing 23. The outer shell 21 covers the inner shell 19 together with the terminals 15. An outer rear closing plate 75 is joined to the outer housing insertion opening 73 by way of the hinges 43. Outer engagement frames 77 are provided on both sides of the outer rear closing plate 75. At the position where the outer rear closing plate 75 has closed the outer housing insertion opening 73, the outer engagement frames 77 are engaged with outer engagement projections 79 projectingly provided on the respective outer interior walls 55. The outer rear closing plate 75 thereby keeps closed the outer housing insertion opening 73.

A pair of resilient contact pieces 80 whose leading ends act as free ends; for instance, are formed in the outer rear closing plate 75. The resilient contact pieces 80 contact the inner rear closing plate 45 of the inner shell 19. Second board connection portions 81 to be soldered to corresponding through holes of the circuit board and connected to a ground of the same are provided upright on the outer rear closing plate 75. Third board connection portions 83 and fourth board connection portions 85 to be soldered to corresponding through holes of the circuit board and connected to a ground of the same are provided upright on the outer shell 21. Of these connection portions, the fourth board connection portions 85 have each a center slit and thereby assumes a shape of a two-pronged nail, to thus become resiliently engageable with each of corresponding through holes of the circuit board and able to tentatively fix the outer shell 21 to the circuit board.

The outer shell 21 is provided with a collapse prevention structure that is engaged with a free end 87 of the cantilever wall 57, thereby preventing inward collapse of the connector. In the embodiment, the collapse prevention structure includes supporting projections 91. The supporting projections 91 are cut and thereafter raised straight up in respective upper portions of leading-side side walls 89 of the outer shell 21. The respective supporting projections 91 are engaged with the respective receiving grooves 61 that are formed in an indented manner in the respective free-end side surfaces 59 of the cantilever wall 57 along a direction of insertion of the connector.

Operation of the shielded connector 11 having the foregoing structure is now described.

Figure 3:
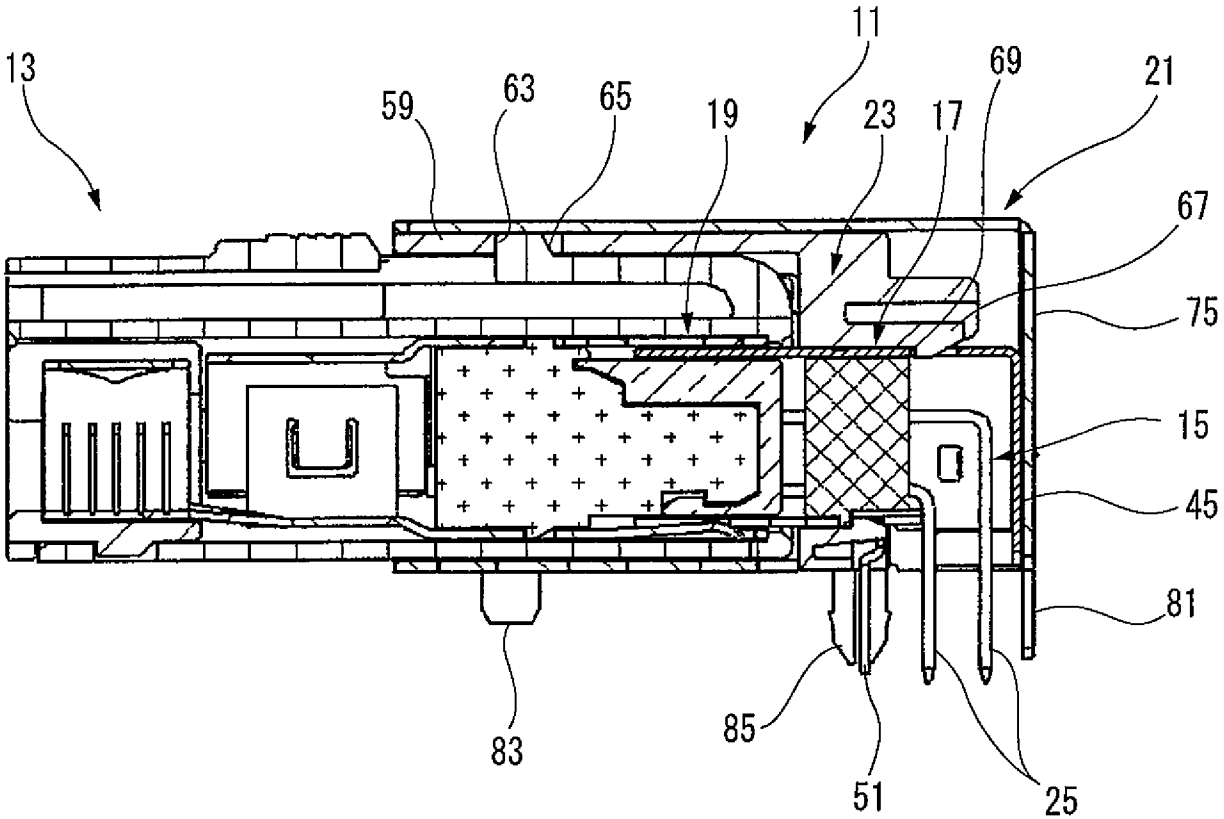
FIG. 3 is a longitudinal cross sectional view showing that the coupling of the shielded connector shown in FIG. 2 to the other connector has finished.

As shown in FIG. 3, in the shielded connector 11 of the present embodiment, the outer housing 23 is provided in the outer shell 21, and the inner shell 19 is provided in the outer housing 23. The inner shell 19 is positioned with respect to the outer shell 21 by means of the outer housing 23 interposed between the outer shell 21 and the inner shell 19.

In the outer housing 23, only the one cantilever wall 57 making up a portion of the external wall is placed so as to oppose a board surface of the circuit board within the outer shell 21. Specifically, the cantilever wall 57 is formed as one side wall of the housing, and there is no wall opposing the cantilever wall 57. This makes it possible to reduce a dimension of the shielded connector 11 with respect to the board surface of the circuit board; namely, to make small a so-called shielded connector.

When the outer housing 23 is inserted into the outer shell 21, the supporting projections 91 of the outer shell 21 are inserted into the receiving grooves 61 formed in the cantilever wall 57 of the outer housing 23. The cantilever wall 57 is supported by the supporting projections 91, whereupon collapse of the cantilever wall 57 to the inside of the connector (i.e., a downward direction in the drawing) is regulated. The collapse prevention structure of the present embodiment is formed from such a simple structure including the receiving grooves 61 and the supporting projections 91. Moreover, when the housing is inserted into the outer shell 21, the free-end side surfaces 59 of the cantilever wall 57 are supported and guided by the supporting projections 91 of the outer shell 21 by way of the receiving grooves 61, thereby preventing rattling or tilting of the outer housing 23. Ease of insertion of the outer housing is thereby improved.

Furthermore, the lock receiving portion 63 to engage with the lock portion 65 of the other connector is provided in the outer housing 23 made from a resin. Hence, it is possible to prevent the wearing away of the lock portion 65 of the other connector that is likewise formed from a resin.

Although the present embodiment has been described by reference to, as an example, a case where the collapse prevention structure is made up of the supporting projections 91 and the receiving grooves 61. However, the shielded connector of the present invention can employ another collapse prevention structure.

Figure 4:
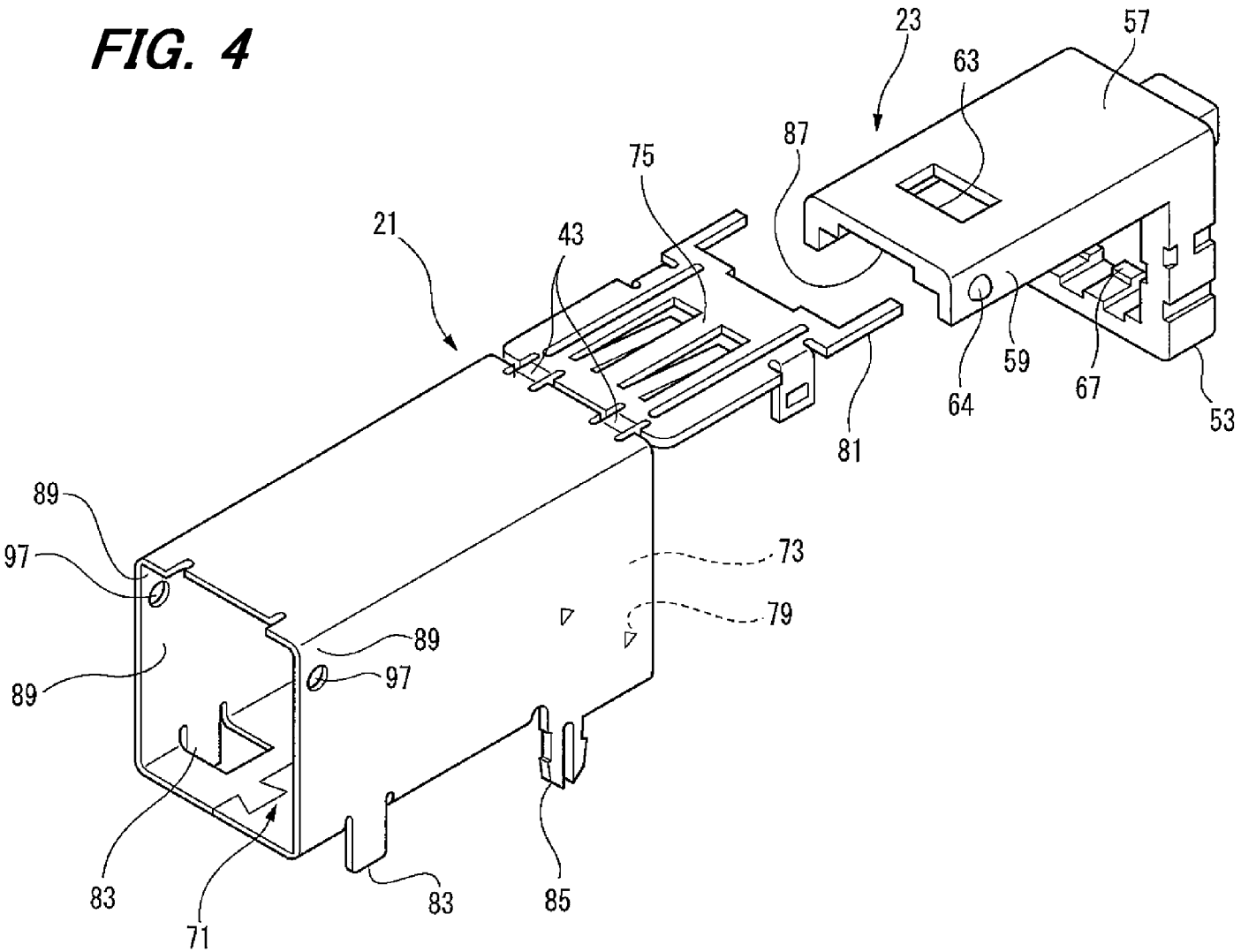
FIG. 4 is a perspective view of an outer shell having a collapse prevention structure of an example modification.
Figure 5A:
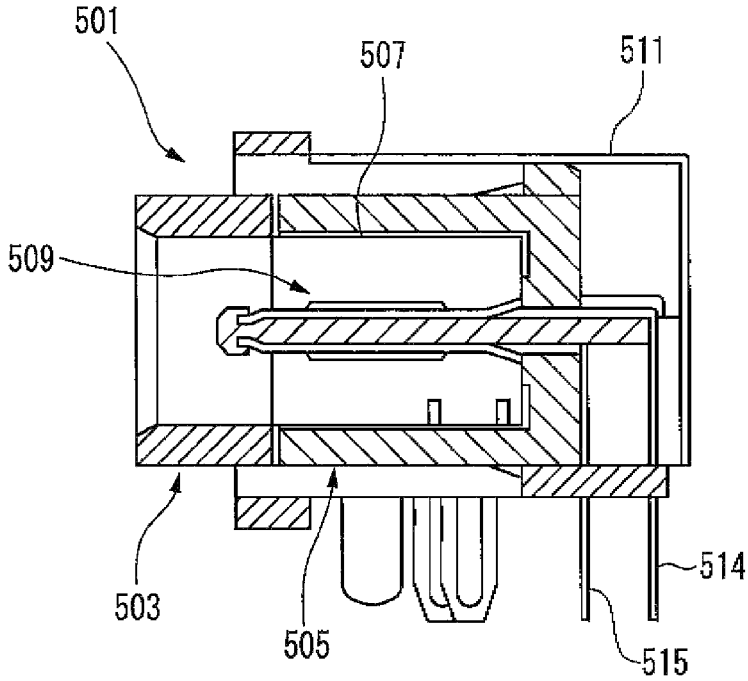
FIG. 5A is a longitudinal cross sectional view of a related art shielded connector in which each of rear ends of board-side terminals has a 90° angle bend.
Figure 5B:
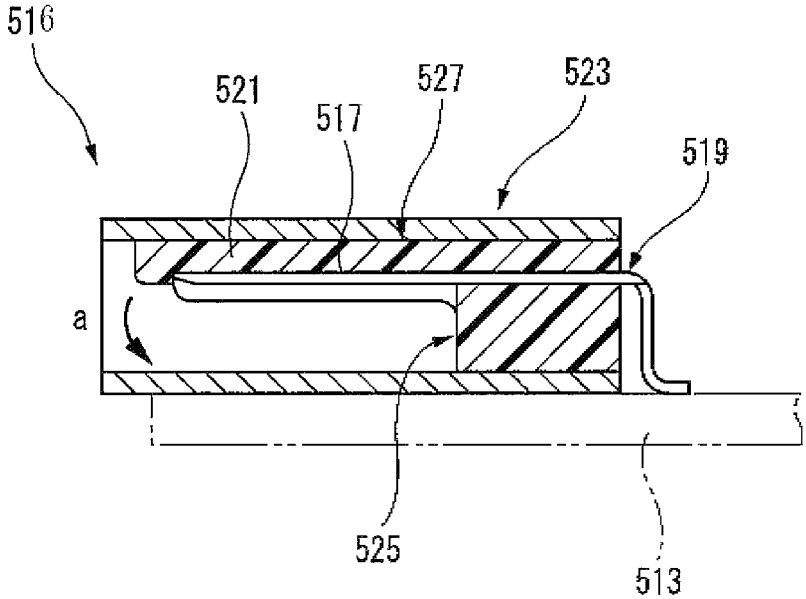
RELATED ART FIG. 5B
FIG. 5B is a longitudinal cross sectional view of the related art shielded connector in which a placement board of a housing main body is formed as one side wall.

As shown in FIG. 4, for instance, indents 64 can be projectingly formed on the respective free-end side surfaces 59 of the cantilever wall 57 of the outer housing 23. Further, indent receiving holes 97 for receiving the respective indents 64 can also be formed in the upper portions of the respective leading-end side walls 89 of the outer shell 21. Even in the case of the example modification, the indents 64 are engaged with the respective indent receiving holes 97, thereby enabling prevention of collapse of the cantilever wall 57.

Accordingly, the shielded connector 11 of the present embodiment enables provision of a compact, superior shielded connector 11 that can prevent collapse of the cantilever wall 57 of the outer housing 23 while pursuing a lower profile.

The shielded connector of the present invention is not restricted to the embodiment and appropriately susceptible to alterations or modifications. In addition, materials, shapes, dimensions, the numbers, and locations of respective constituent elements described in connection with the embodiment are arbitrary and unlimited, so long as the present invention can be accomplished.

The present application is based on Japanese patent application No. 2011-195369 filed on Sep. 7, 2011, and the contents of the patent application are hereby incorporated by reference.

The present invention is useful for providing a shielded connector that can prevent collapse of a cantilever wall in a housing while pursuing a lower profile of the shielded connector.

What is claimed is:

1. A shielded connector comprising:

a tubular inner shell that covers terminals for connection with another connector;

an outer shell that covers the tubular inner shell; and a housing for retaining the tubular inner shell in the outer shell, wherein the housing has a cantilever wall that extends in a direction of insertion of the shielded connector along an interior wall of the outer shell and that has a lock receiving portion to engage with a lock portion of the other connector, and wherein the outer shell has a collapse prevention structure that prevents the cantilever wall from being collapsed to an inward direction of the connector upon engagement with a free end of the cantilever wall.

2. The shielded connector according to claim 1, wherein the collapse prevention structure is made up of supporting projections that are projectingly provided on leading-side side walls of the outer shell so as to engage with receiving grooves formed, in an indented manner, in free-end side walls of the cantilever wall along a direction of insertion of the connector.

* * * * *